US009897368B2

(12) United States Patent
Lee

(10) Patent No.: US 9,897,368 B2
(45) Date of Patent: Feb. 20, 2018

(54) REFRIGERATOR INCLUDING A DOOR OPENING DEVICE

(71) Applicant: DONGBU DAEWOO ELECTRONICS CORPORATION, Seoul (KR)

(72) Inventor: Sung Hwan Lee, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 0 days.

(21) Appl. No.: 15/365,368

(22) Filed: Nov. 30, 2016

(65) Prior Publication Data

US 2017/0336131 A1 Nov. 23, 2017

(30) Foreign Application Priority Data

May 17, 2016 (KR) ..... 10-2016-0060375

(51) Int. Cl.

| | |
|---|---|
| ***A47B 96/04*** | (2006.01) |
| ***F25D 23/02*** | (2006.01) |
| ***E05F 11/54*** | (2006.01) |
| ***E05F 11/10*** | (2006.01) |
| ***F25D 11/02*** | (2006.01) |

(52) U.S. Cl.

CPC ..... *F25D 23/028* (2013.01); *E05F 11/10* (2013.01); *E05F 11/54* (2013.01); *F25D 11/02* (2013.01); *E05Y 2900/31* (2013.01)

(58) Field of Classification Search

CPC ..... F25D 23/028; F25D 11/02; E05F 11/10; E05F 11/54; E05Y 2900/31

See application file for complete search history.

(56) References Cited

U.S. PATENT DOCUMENTS

| | | | | |
|---|---|---|---|---|
| 2,659,115 | A * | 11/1953 | Anderson | E05C 19/161 292/251.5 |
| 5,908,228 | A * | 6/1999 | Lee | E05B 17/0033 292/251.5 |
| 5,915,805 | A * | 6/1999 | Lee | E05B 17/0033 292/251.5 |
| 6,655,765 | B2 * | 12/2003 | Kawamura | E05B 1/0015 312/296 |
| 8,277,005 | B2 * | 10/2012 | Jung | F25D 23/028 16/412 |
| 2008/0000052 | A1 * | 1/2008 | Hong | E05B 17/0033 16/382 |

(Continued)

FOREIGN PATENT DOCUMENTS

KR 10-2010-0042002 A 4/2010

*Primary Examiner* — Hanh V Tran

(57) ABSTRACT

A refrigerator equipped with a door opening device that can be triggered to facilitate door opening when a door handle is moved by a user in either of the two permitted opposite directions. A first link member is coupled to the door handle and can be rotated in the same direction as the door handle. A second link member is coupled to the first link member. The second link member is configured to be rotated by the first link member when the door handle is rotated in one direction, and to remain stationary when the door handle is rotated in another direction. When door handle is rotated, the first or the second link member can cause a slide member to slide out of the refrigerator door partially to press against the main body, thereby opening the door.

14 Claims, 8 Drawing Sheets

(56) References Cited

U.S. PATENT DOCUMENTS

| | | | | |
|---|---|---|---|---|
| 2009/0139260 | A1* | 6/2009 | Yoshikawa | E05B 7/00 62/449 |
| 2009/0179540 | A1* | 7/2009 | Seo | E05B 17/0033 312/405 |
| 2009/0205357 | A1* | 8/2009 | Lim | E05B 17/0033 62/441 |
| 2011/0050065 | A1* | 3/2011 | Lee | E05B 17/0033 312/402 |
| 2011/0050066 | A1* | 3/2011 | Lee | A47B 95/02 312/404 |
| 2011/0132024 | A1* | 6/2011 | Lim | E05B 17/0033 62/449 |
| 2011/0273070 | A1* | 11/2011 | Shin | F25D 23/028 312/405 |
| 2012/0280608 | A1* | 11/2012 | Park | E05B 1/0015 312/405 |
| 2013/0270990 | A1* | 10/2013 | Park | F25D 23/00 312/404 |
| 2014/0319989 | A1* | 10/2014 | Hwang | F25D 23/02 312/404 |
| 2015/0275545 | A1* | 10/2015 | Lee | E05B 65/0042 312/405 |
| 2015/0292793 | A1* | 10/2015 | Bischoff | F25D 23/028 312/404 |
| 2017/0051542 | A1* | 2/2017 | Reske | E05B 63/244 |

* cited by examiner

REFRIGERATOR INCLUDING A DOOR OPENING DEVICE

CROSS-REFERENCE TO RELATED APPLICATION

This application is based on and claims priority from Korean Patent Application No. 10-2016-0060375, filed on May 17, 2016, the disclosure of which is incorporated herein in its entirety by reference for all purposes.

TECHNICAL FIELD

The present disclosure relates to refrigerators including door opening device.

BACKGROUND

Refrigerators are electrical appliances capable of maintaining a storage chamber below room temperature. Food or other objects can be stored in a refrigerator in a cold or frozen state. The space inside the refrigerator is maintained at a low temperature by cool air circulation. Cool air is continuously generated through refrigeration cycles, each cycle including compression, condensation, expansion and evaporation. Cool air is distributed to the inner space of the refrigerator by convection.

A top-mount type refrigerator has a freezer disposed above a refrigeration chamber. A bottom-freezer type refrigerator has a freezer disposed below a refrigeration chamber. A side-by-side type refrigerator has a freezer and a refrigeration chamber disposed side by side.

Some refrigerators are equipped with a door opening device coupled to a rotatable or pivotable door handle which allows a user to open the refrigerator door easily by turning the handle and without manually pulling the door open.

However, a conventional rotatable door opening device only allows the door handle to pivot in a specific direction to open the door. For instance, if a horizontal door handle is designed to pivot downward, a user would not be able to trigger the door opening mechanism by pushing it upward.

SUMMARY

Embodiments of the present disclosure provide a refrigerator equipped with a door opening device that can be triggered to facilitate door opening when a door handle is moved in either of the two permitted opposite directions.

The present disclosure provides a refrigerator comprising: a main body; a refrigerator door rotatably coupled to the main body and configured to cover storage spaces; and a door opening device installed in the refrigerator door, wherein the door opening device includes: a handle configured to rotate in two directions; a link part configured to rotate together with the handle when the handle is rotated in one of the two directions; and a slide member configured to slide in response to rotation of the link part and thereby push the refrigerator door to an open position.

The link part may include: a first link member coupled to the handle and configured to rotate in the same direction as the rotation direction of the handle when the handle is rotated by a user; and a second link member having one end disposed in contact with the first link member and configured to rotate together with the first link member when the first link member is rotated.

When the handle is turned by a user in a first direction, the first link member may be configured to press the slide member to slide. When the handle is turned in the second direction by a user, the second link member is rotated by the first link member to press the slide member to move.

The second link member may remain stationary when the first link member is rotated in the first direction; and the second link member is rotated when the first link member is rotated in the second direction.

A first pressing portion at one side of the first link member is configured to press the slide member to move when the first link member is rotated in the first direction. The first pressing portion is configured to move away from the slide member when the first link member is rotated in the second direction.

A tab at the other side of the first link member may be configured to move away from the second link member when the first link member is rotated in the first direction. The tab is configured to press and rotate the second link member when the first link member is rotated in the second direction.

A second pressing portion at one side of the second link member may be configured to press the slide member on one side. This side of the sliding member faces the second pressing portion and is depressed inward in conformity with the outer surface of the second pressing portion.

DETAILED DESCRIPTION

Figure 1:
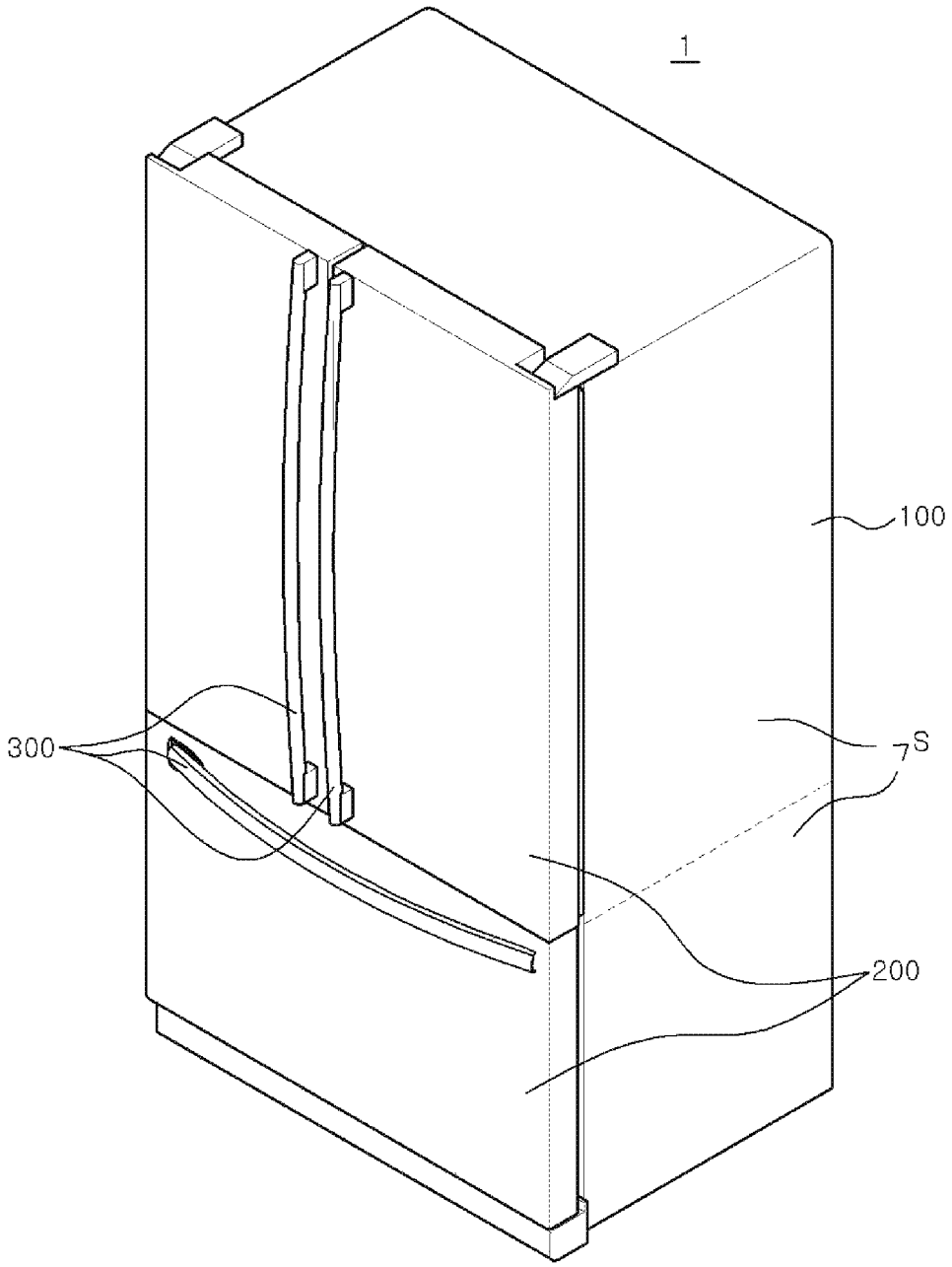
FIG. 1 illustrates a perspective view of an exemplary refrigerator according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in size, and a predetermined size is just exemplary and not limitating. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

Preferred embodiments of the present disclosure will now be described in detail with reference to the accompanying drawings.

Figure 2:
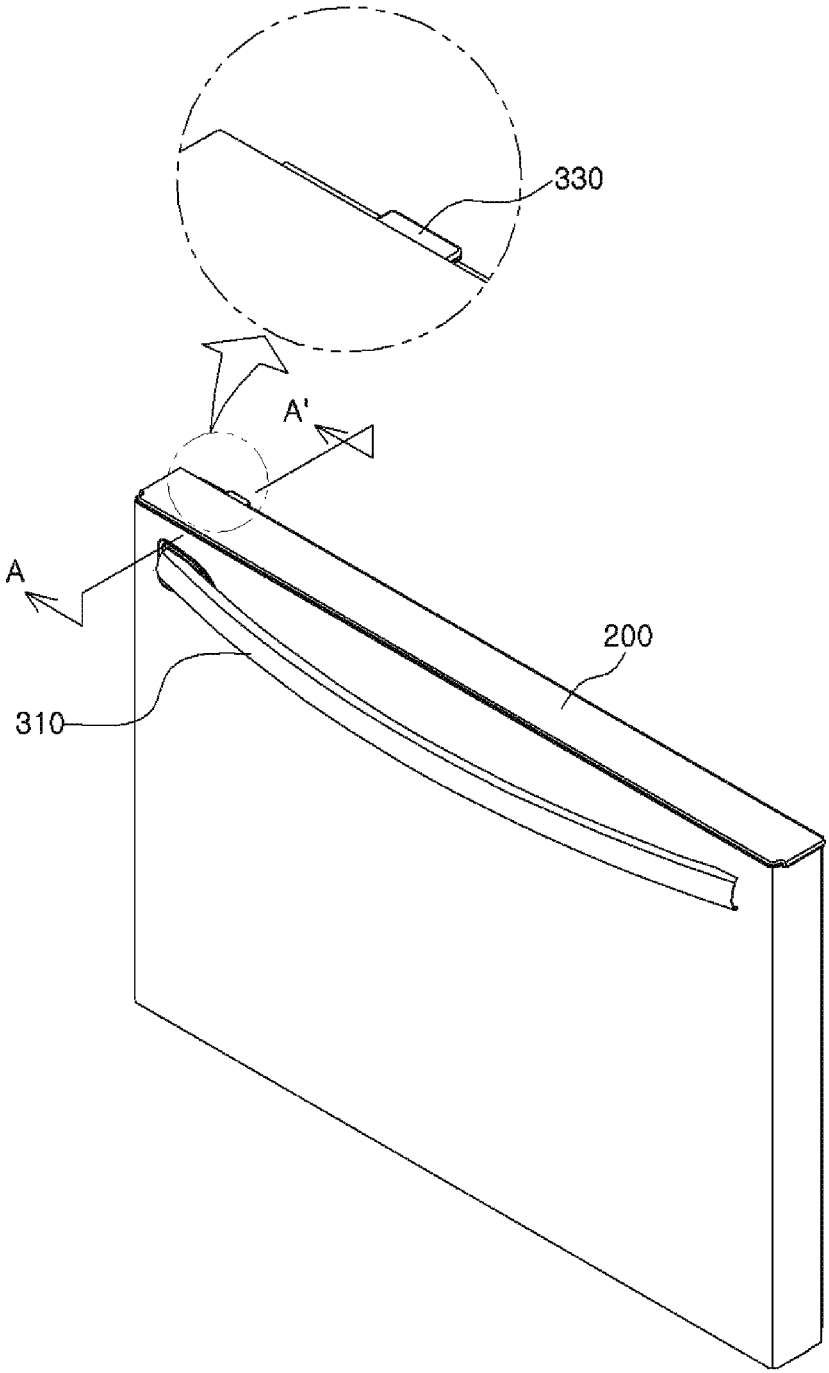
FIG. 2 illustrates a perspective view of an exemplary refrigerator door according to one embodiment of the present disclosure.
Figure 3:
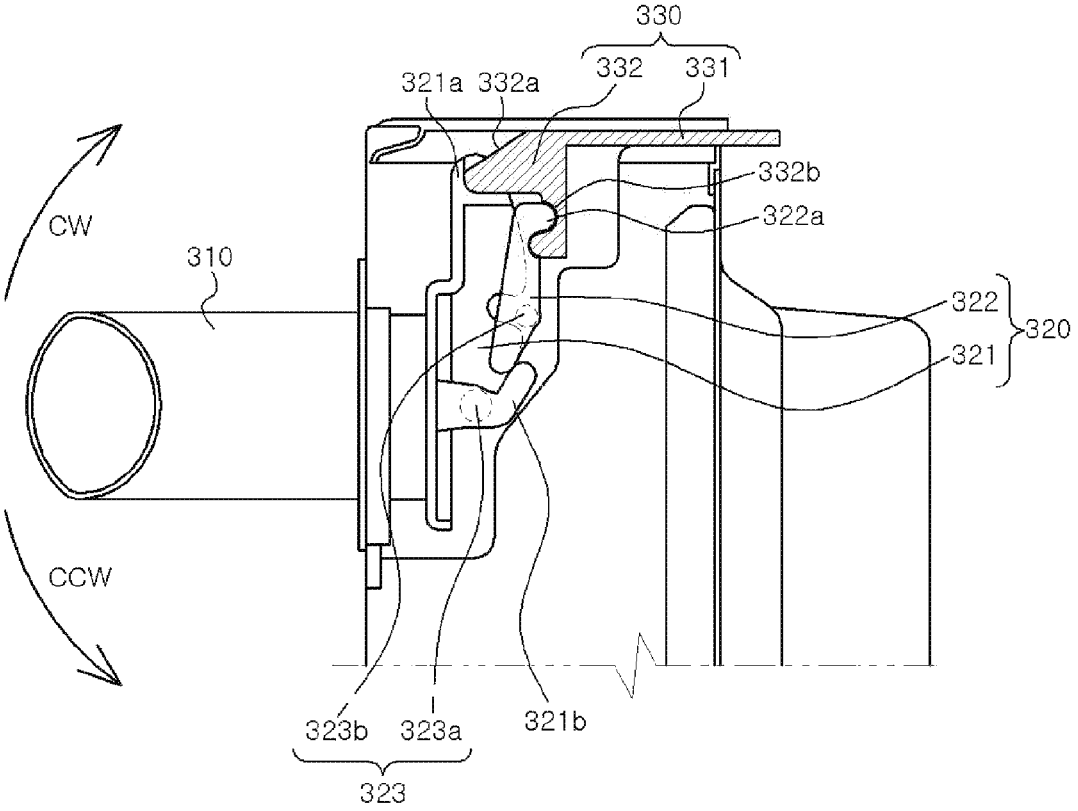
FIG. 3 is a sectional view of the refrigerator door taken along line A-A' in FIG. 2.
Figure 4:
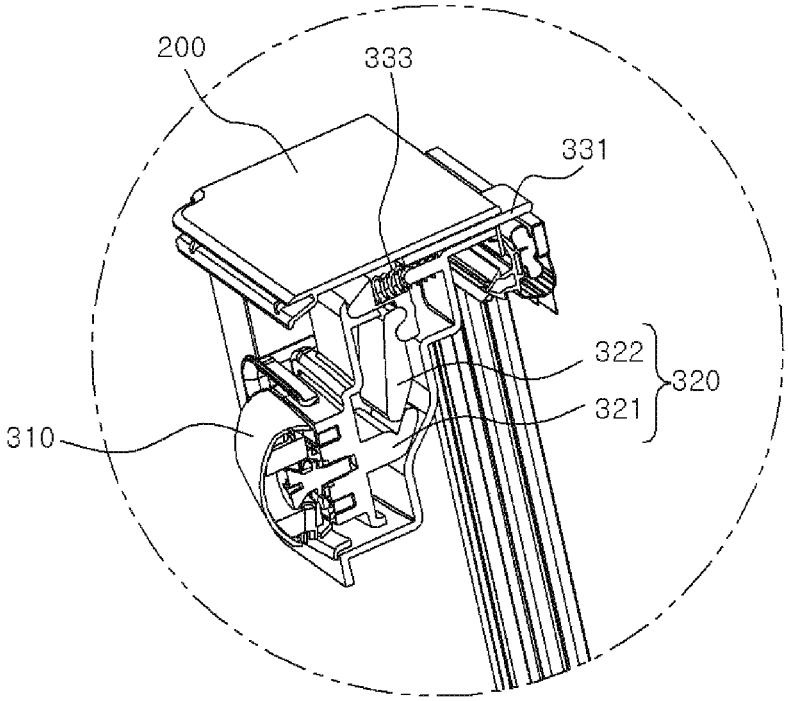
FIG. 4 illustrates a partial perspective view of the exemplary refrigerator door according to one embodiment of the present disclosure.
Figure 5:
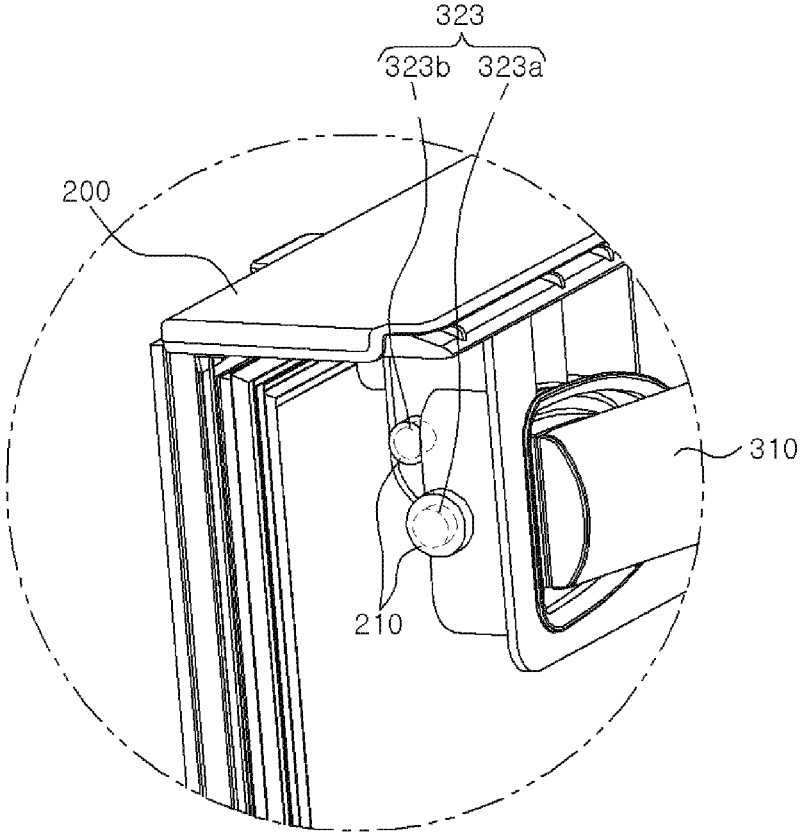
FIG. 5 illustrates another partial perspective view of the exemplary refrigerator door according to one embodiment of the present disclosure.
Figure 6A:
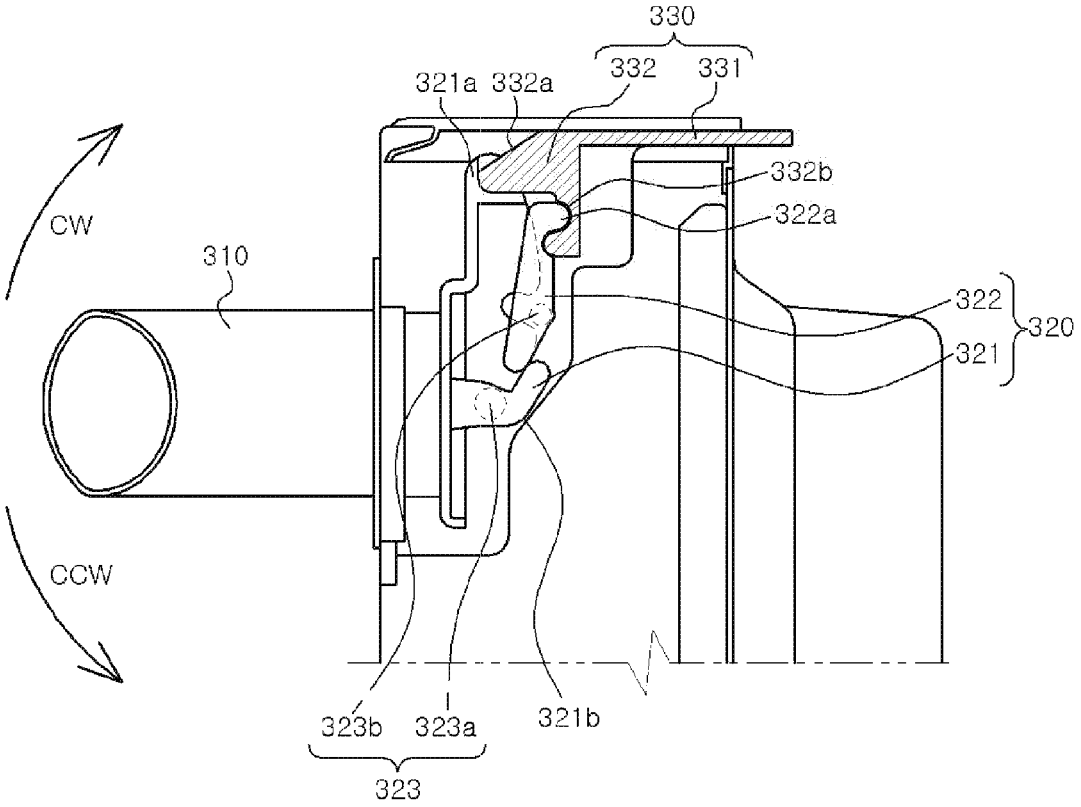
FIG. 6A illustrates the exemplary door opening mechanism when the door is closed according to one embodiment of the present disclosure.
Figure 6B:
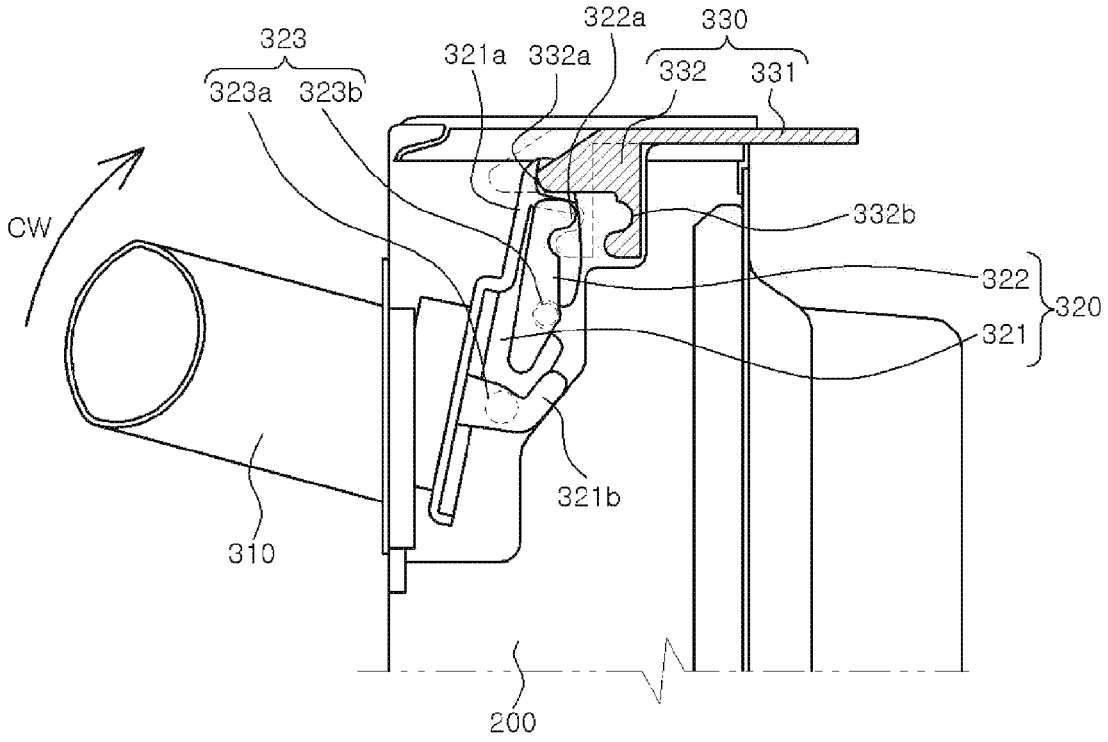
FIG. 6B illustrates an exemplary door opening mechanism when the door handle is turned in the first direction according to one embodiment of the present disclosure.
Figure 6C:
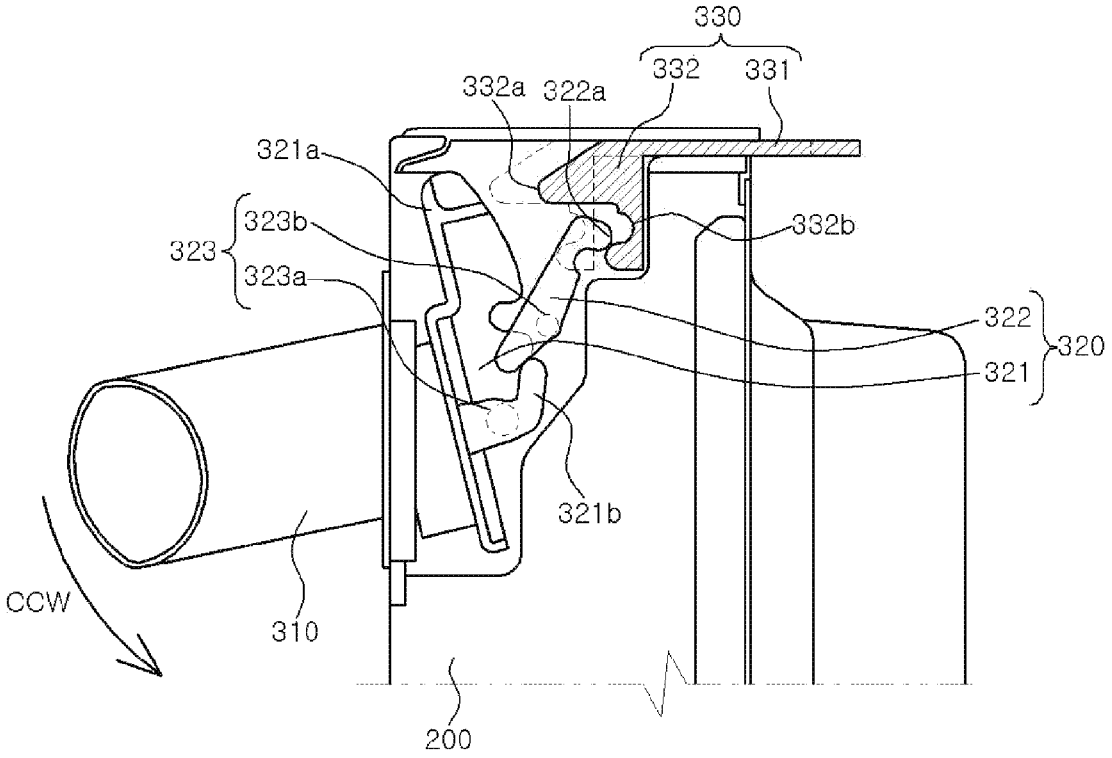
FIG. 6C illustrates the exemplary door opening mechanism when the door handle is turned in the second direction according to one embodiment of the present disclosure.

FIG. 1 illustrates a perspective view of an exemplary refrigerator according to one embodiment of the present disclosure. FIG. 2 illustrates a perspective view of an exemplary refrigerator door according to one embodiment of the present disclosure. FIG. 3 is a sectional view of the refrigerator door taken along line A-A' in FIG. 2. FIG. 4 illustrates a partial perspective view of the exemplary refrigerator door according to one embodiment of the present disclosure. FIG. 5 illustrates a partial perspective view of the exemplary refrigerator door according to one embodiment of the present disclosure, which is viewed at an angle differing from FIG. 4. FIG. 6A illustrates the exemplary door opening mechanism when the door is closed according to one embodiment of the present disclosure. FIG. 6B illustrates an exemplary door opening mechanism when the door handle is turned in the first direction according to one embodiment of the present disclosure. FIG. 6C illustrates the exemplary door opening mechanism when the door handle is turned in the second direction according to one embodiment of the present disclosure.

Referring to FIGS. 1 to 6C, the exemplary refrigerator 1 may include a main body 100 having multiple storage chambers. A refrigerator door 200 is coupled to the main body 100 and configured to cover the storage chambers. A door opening device 300 is installed in the refrigerator door 200.

While a bottom-freeze type refrigerator is illustrated in FIG. 1, it will be appreciated that embodiments of the present disclosure can be applied to various other types of refrigerators, such as a top-mount type or a side-by-side type.

The main body 100 serves as the main frame and housing of the refrigerator 1 and includes storage spaces S. The refrigerator door 200 is rotatably (e.g., hingedly) coupled to the main body 100.

The door opening device 300 in the refrigerator door 200 can be triggered to facilitate opening of the door responsive to a user action on the door handle.

For example, if the free end of the refrigerator door 200 is coupled to the main body 100 by a magnetic force, a user may open the refrigerator door 200 by rotating the door handle, and yet without manually pulling the door open to overcome the magnetic force. A door opening device 300 according to the present disclosure may be installed in some or all refrigerator doors in a refrigerator.

Hereinafter, as an example, description is made based on a door opening device 300 disposed in a lower part of the main body 100 with a horizontal door handle. The door opening device 300 includes a handle 310, a link part 320 and a slide member 330.

The handle 310 is pivotably (or rotatably) coupled to the refrigerator door 200 through the link part 320. However, the present disclosure is not limited thereto. The handle is partially planted in the door. According to the present disclosure, a user can either push up or push down the handle 310 to trigger the door opening device. Shown in FIG. 3, the handle 310 can turn clockwise (CW) as well as counterclockwise (CCW). However, this description is based on the illustration of the drawings. Depending on the arrangement and configuration of the handle 310, the handle 310 may be turned in any two opposite directions with reference to the refrigerator door, such as up/down or left/right.

The link part 320 is inside the door 200 and coupled to the handle 310. The link part 320 may be rotatably coupled to the refrigerator door 200. For example, the link part 320 may include a pivot shaft 323. The refrigerator door 200 may include a pivot shaft coupling member 210 into which the pivot shaft 323 is rotatably inserted. When the handle is turned by a user in either allowed direction, the link part 320 is rotated as a result.

When the link part 320 is rotated, it pushes the slide member 330 to slide. The link part 320 may include a first link member 321 and a second link member 322. The first link member is coupled to the handle 310 and configured to rotate in the same direction as the handle 310. The second link member 322 has one end in direct contact with the first link member 321 and can be rotated along with the first link member 321.

The first link member 321 may be rotatably coupled to the refrigerator door 200 and operable to press the slide member 330 to slide. For example, the first link member 321 may be coupled to the refrigerator door 200 through a first pivot shaft 323*a* protruding from one surface of the first link member 321.

The first link member 321 may be disposed inside the refrigerator door 200. When the handle 310 is rotated by a user, the first link member 321 is rotated and presses the slide member 330. For example, as illustrated in FIG. 3, the first link member 321 may rotate clockwise (CW) to press the slide member 330 when the handle 310 is rotated clockwise (CW). A first pressing portion 321*a* may protrude from the other surface of the first link member 321. The first pressing portion 321*a* may operate to push the slide member 330 to slide or move away from the slide member 330 depending on the rotational direction of the first link member 321.

For instance, when the handle 310 is rotated clockwise (CW), the first link member 321 is rotated clockwise (CW) as well. Thus, the first pressing portion 321*a* may press the slide member 330 to slide. Conversely, if the handle 310 is rotated counterclockwise (CCW), the first link member 321 may also be rotated counterclockwise (CCW). Thus, the first pressing portion 321*a* is moved away from the slide member 330 (see FIG. 6C).

The second link member 322 may be rotatably coupled to the refrigerator door 200. For example, the second link member 322 may be rotatably installed inside the refrigerator door 200 through a second pivot shaft 323*b*.

If the handle 310 is rotated in the other direction, the second link member 322 may be rotated by the first link member 321 to press the slide member 330. In other words, if the handle 310 is rotated counterclockwise (CCW) as shown in FIG. 3, the first link member 321 may be rotated counterclockwise (CCW) accordingly. A tab 321*b* protruding from the other surface of the first link member 321 may press the second link member 322 to rotate clockwise (CW). Thus, a second pressing portion 322*a* disposed on one side of the second link member 322 may press the slide member 330 to slide. In this case, the second pressing portion 322*a* may protrude outward in a round shape to reduce resistance. One side portion of the slide member 330 that is contact with the second pressing portion 322*a* may be depressed inward in a round shape in conformity with the contour of the second pressing portion 322*a*.

Thus, if the first link member 321 is rotated in a particular direction (clockwise in FIG. 3), the second link member 322 may remain stationary. Only when the first link member 321 is rotated in the other direction (counterclockwise in FIG. 3) does the second link member 322 rotate to press the slide member 330.

In other words, if the first link member 321 is rotated clockwise (CW), the tab 321*b* may be moved away from the second link member 322 and therefore the second link member 322 remains stationary. On the other hand, if the first link member 321 is rotated counterclockwise (CCW), the tab 321*b* may press the second link member 322 to rotate, and the second link member 322 then presses the slide member 330 to slide.

As a result, if the handle 310 is turned in one direction (e.g., clockwise in FIG. 3), the first link member 321 may press the slide member 330 to move, which pushes the refrigerator door 200 to open. If the handle 310 is rotated in the other direction (e.g., counterclockwise in FIG. 3), the second link member 322 may press the slide member 330 to move, which pushes the refrigerator door 200 to open.

When the slide member 330 is pressed to slide by the link part 320, the slide member 330 presses against the main body 100 to overcome the force that holds the refrigerator door and the main body together. As a result, at least a portion of the slide member 330 protrudes beyond the refrigerator door 200, thereby causing the refrigerator door 200 to separate from the main body 100. When the link part 320 is not rotated, the entire slide member 330 is retained in its base position inside the refrigerator door 200 by an elastic member 333.

The slide member 330 may include, for example, a first slide member 331 at least partially exposed to the outside of the refrigerator door 200 by the link part 320, and a second slide member 332 coupled to one side of the first slide member 331 and disposed within the refrigerator door 200. The second slide member 323 may directly contact the link part 320.

When the slide member 330 is pressed to slide, the first slide member 331 may protrude out of the refrigerator door 200 and have one end pressed against the main body 100. Thus, the refrigerator door 200 can be pushed away from the main body 100 to an open position.

The second slide member 332 may be coupled to one side of the first slide member 331 and installed inside the refrigerator door 200. The link part 320 can apply a force on the second slide member 33. The first slide member 331 and the second slide member 332 may be manufactured as separate components and assembled together during installation. Alternatively, they can be formed integrally at one time, e.g., by molding.

The second slide member 332 may include, for example, a first contact portion 332*a* which contacts the first link member 321 and a second contact portion 332*b* which contacts the second link member 322. The configuration of the first contact portion 332*a* and the second contact portion 332*b* may be configured in various suitable mechanical link structures that are well known in the art.

As described above, according to embodiments of the present disclosure, a slide member may be triggered to slide and thereby open the refrigerator door 200 when the door handle is rotated in either of the two permitted directions. This advantageously eliminates the restriction that a user can only turn the door handle in a single particular direction to open the door.

Although exemplary embodiments of the present disclosure are described above with reference to the accompanying drawings, those skilled in the art will understand that the present disclosure may be implemented in various manners without changing the necessary features or the spirit of the present disclosure.

Therefore, it should be understood that the embodiments described above are not limiting, but only exemplary. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A refrigerator comprising:

a main body comprising a storage space;

a refrigerator door coupled to the main body; and a door opening device comprising a door handle, wherein the door handle is operable to be moved in two opposite directions relative to the refrigerator door, and wherein the door opening device is configured to cause the refrigerator door to open in response to the door handle being moved in either of the two opposite directions, wherein the door opening device further comprises a link part operable to be rotated when the door handle is rotated in either one of the two opposite directions, and a slide member configured to slide in response to rotation of the link part and to be pressed against the main body to separate the refrigerator door and the main body, wherein the link part comprises a first link member coupled to the door handle and operable to be rotated responsive to rotation of the door handle, and a second link member disposed in contact with the first link member at one side and operable to be rotated when the first link member is rotated, and wherein the first link member is configured to force the slide member to slide when the door handle is rotated in a first direction, and wherein the second link member is configured to be rotated by the first link member and force the slide member to slide when the handle is rotated in a second direction opposite to the first direction.

2. The refrigerator of claim 1, wherein the door handle is operable to be rotated in the two opposite directions by force applied by a user.

3. The refrigerator of claim 1, wherein the door opening device comprises components installed inside the refrigerator door.

4. The refrigerator of claim 1, wherein the second link member is configured to remain stationary when the first link member is rotated in the first direction, and wherein the second link member is rotated when the first link member is rotated in the second direction opposite to the first direction.

5. The refrigerator of claim 4, wherein a first pressing portion is disposed at one side of the first link member, the first pressing portion configured to: press the slide member to slide when the first link member is rotated in the first direction; and move away from the slide member when the first link member is rotated in the second direction.

6. The refrigerator of claim 5, wherein a tab is disposed at another side of the first link member, the tab configured to be moved from the second link member when the first link member is rotated in first direction, and wherein the tab is configured to press and rotate the second link member when the first link member is rotated in the second direction.

7. The refrigerator of claim 6, wherein a second pressing portion is disposed at one side of the second link member, the second pressing portion configured to press the sliding member to slide, and wherein one side portion of the slide member facing the second pressing portion is depressed inward in a round shape in conformity with a contour of the second pressing portion.

8. The refrigerator of claim 7, wherein the second pressing portion comprises an outer surface protruding outward in a round shape.

9. The refrigerator of claim 1, wherein the refrigerator door is rotatably coupled to the main body.

10. A refrigerator comprising:

a main body;

a refrigerator door coupled to the main body; and a door opening device coupled to the refrigerator door, wherein the door opening device comprises:

a door handle configured to be rotated in two opposite directions;

a first link member coupled to the door handle and configured to be rotated in a same direction as the door handle;

a second link member coupled to the first link member and configured to be rotated when the first link member is rotated; and a slide member coupled to the first link member and the second link member and configured to open the refrigerator door by pressing against the main body, wherein the first link member is rotated to press the slide member to slide when the door handle is rotated in a first direction, and wherein the second link member is rotated in response to rotation of the first link member to press the slide member to slide when the door handle is rotated in a second direction.

11. The refrigerator of claim 10, wherein the second link member is configured to remain stationary the door handle is rotated in the first direction.

12. The refrigerator of claim 11, wherein a first pressing portion is disposed at one side of the first link member, the first pressing portion configured to: press the slide member to slide when the door handle is rotated in the first direction; and move away from the slide member when the door handle is rotated in the second direction.

13. The refrigerator of claim 12, wherein a tab is disposed at another side of the first link member, the tab configured to be moved from the second link member when the door handle is rotated in the first direction, the tab configured to press and rotate the second link member when the door handle is rotated in the second direction.

14. The refrigerator of claim 13, wherein a second pressing portion is disposed at one side of the second link member, the second pressing portion configured to press the sliding member, and wherein one side portion of the slide member facing the second pressing portion is depressed inward in a round shape in conformity with an contour of the second pressing portion.

* * * * *